US006179149B1

(12) United States Patent
Yeh

(10) Patent No.: US 6,179,149 B1
(45) Date of Patent: Jan. 30, 2001

(54) COLLAPSIBLE BASKET ASSEMBLY

(75) Inventor: Mao-Lin Yeh, Taichung (TW)

(73) Assignee: Extratec Industrial Co. Ltd., Taichung (TW)

( * ) Notice: Under 35 U.S.C. 154(b), the term of this patent shall be extended for 0 days.

(21) Appl. No.: 09/420,996

(22) Filed: Oct. 20, 1999

(51) Int. Cl.[7] ..... B65D 6/00
(52) U.S. Cl. ..... 220/485; 220/6; 220/7
(58) Field of Search ..... 220/485, 4.28, 220/4.33, 6, 7

(56) References Cited

U.S. PATENT DOCUMENTS 803,200 * 10/1905 Stripe ..... 220/485 X
1,208,020 * 12/1916 Ross ..... 220/485 X
1,950,376 * 3/1934 Alexander ..... 220/485 X
3,556,058 * 1/1971 Smiler ..... 220/485 X
4,526,285 * 7/1985 Cerveny et al. ..... 220/485 X
5,819,933 * 10/1998 Hernandez ..... 220/485 X

* cited by examiner

*Primary Examiner*—Steven Pollard
(74) *Attorney, Agent, or Firm*—Vinson & Elkins, L.L.P.

(57) ABSTRACT

A collapsible basket assembly includes a basket having a front wall, a rear wall, two opposite side walls interconnecting the front and rear walls, and a bottom wall. The side walls have top edges, and bottom edges connected releaseably and pivotally to the bottom wall. Each of the top edges of the side walls has two loops formed on opposite ends thereof. The front and rear walls have top edges, and bottom edges connected pivotally to the bottom wall. Each of the top edges of the front and rear walls has two protrusions extending in opposite directions from opposite ends thereof. Each of the protrusions extends through one of the loops on a respective one of the top edges of the side walls. Two locking members are connected removably to the protrusions to prevent disengagement between the protrusions and the loops.

1 Claim, 8 Drawing Sheets

COLLAPSIBLE BASKET ASSEMBLY

BACKGROUND OF THE INVENTION

1. Field of the Invention

This invention relates to a basket assembly, more particularly to a collapsible basket assembly for receiving tennis balls.

2. Description of the Related Art

Referring to FIGS. 1 and 2, a conventional basket assembly 10 is shown to comprise a basket 11 and a pair of U-shaped members 12. The basket 11 has grating walls that are formed of metal rods 111 and that are welded to one another to define a space for receiving tennis balls. Two horizontal pivot tubes 113 are fixed to front and rear walls of the basket 11. Each of the U-shaped members 12 is made of metal and has two arm portions with bent distal ends 121. The bent distal ends 121 are inserted into opposite ends of the pivot tubes 113 in order to connect pivotally the basket 11 and the U-shaped members 12. In use, each of the U-shaped members 12 is rotated downwardly to permit the arm portions thereof to be kept between two metal rods 111 and engage frictionally the same in order to support the basket 11, as best illustrated in FIG. 1. Alternatively, each of the U-shaped members 12 is rotated upwardly to serve as a handle, as best illustrated in FIG. 2. However, since the grating walls of the basket 11 are welded to one another, the volume of the basket 11 is fixed. The basket 11 is bulky and is difficult to store and transport. In addition, the arm portions of the U-shaped members 12 are liable to disengage from and move away from the opposite sides of the basket 11.

SUMMARY OF THE INVENTION

The object of the present invention is to provide a collapsible basket assembly that can be stored and transported easily.

Another object of the present invention is to provide a collapsible basket assembly having a basket and two U-shaped members with two arm portions that can be connected positively to the basket when in use.

According to the present invention, a collapsible basket assembly comprises a basket having a front wall, a rear wall, two opposite side walls interconnecting the front and rear walls, and a bottom wall. The side walls have top edges, and bottom edges connected releaseably and pivotally to the bottom wall. Each of the top edges of the side walls has two loops formed on opposite ends thereof. The front and rear walls have top edges, and bottom edges connected pivotally to the bottom wall. Each of the top edges of the front and rear walls has two protrusions extending in opposite directions from opposite ends thereof. Each of the protrusions extends through one of the loops on a respective one of the top edges of the side walls. Two locking members are connected removably to the protrusions to prevent disengagement between the protrusions and the loops.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
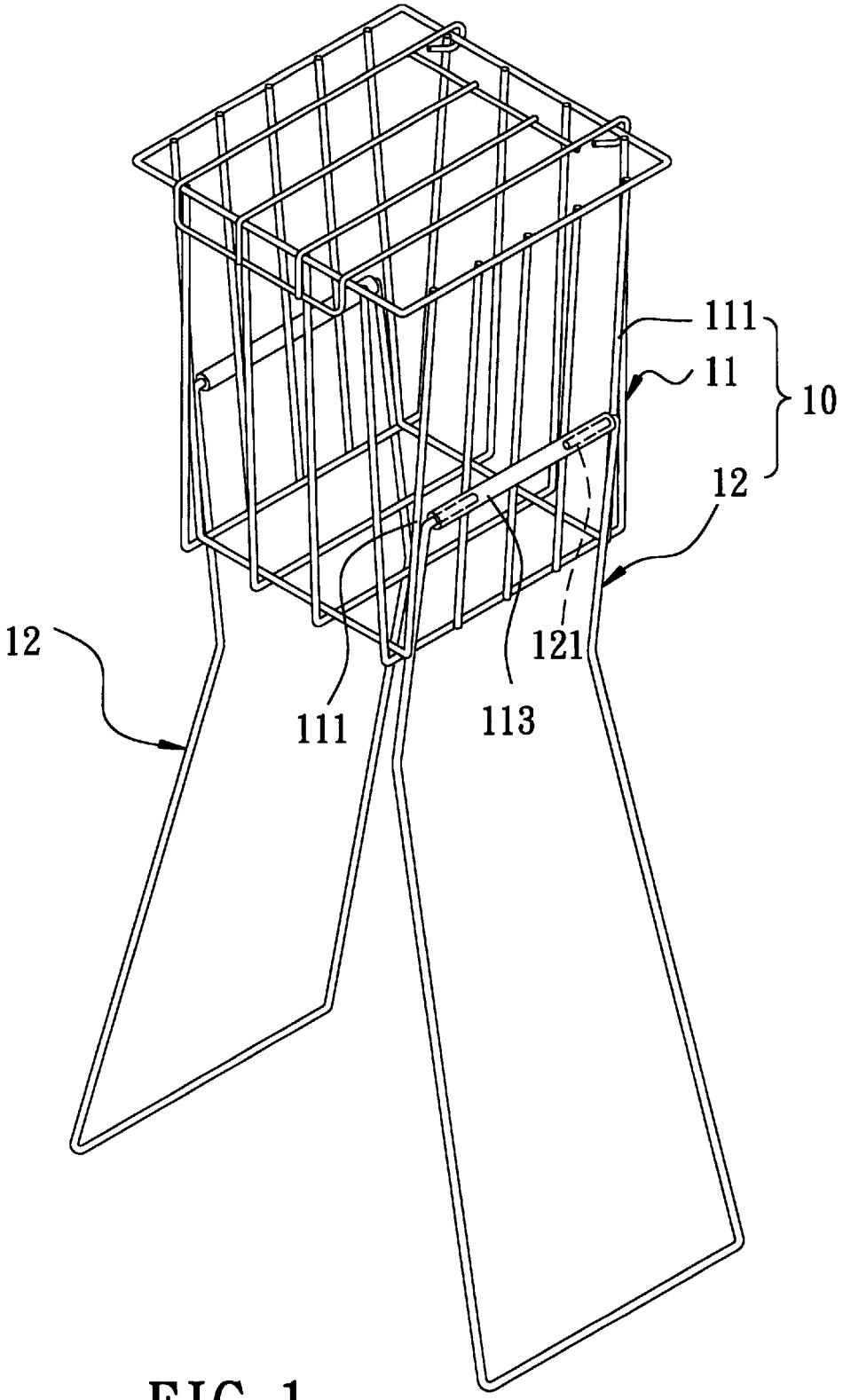
FIG. 1 PRIOR ART
FIG. 1 is a perspective view of a conventional basket assembly in a first operative position.
Figure 2:
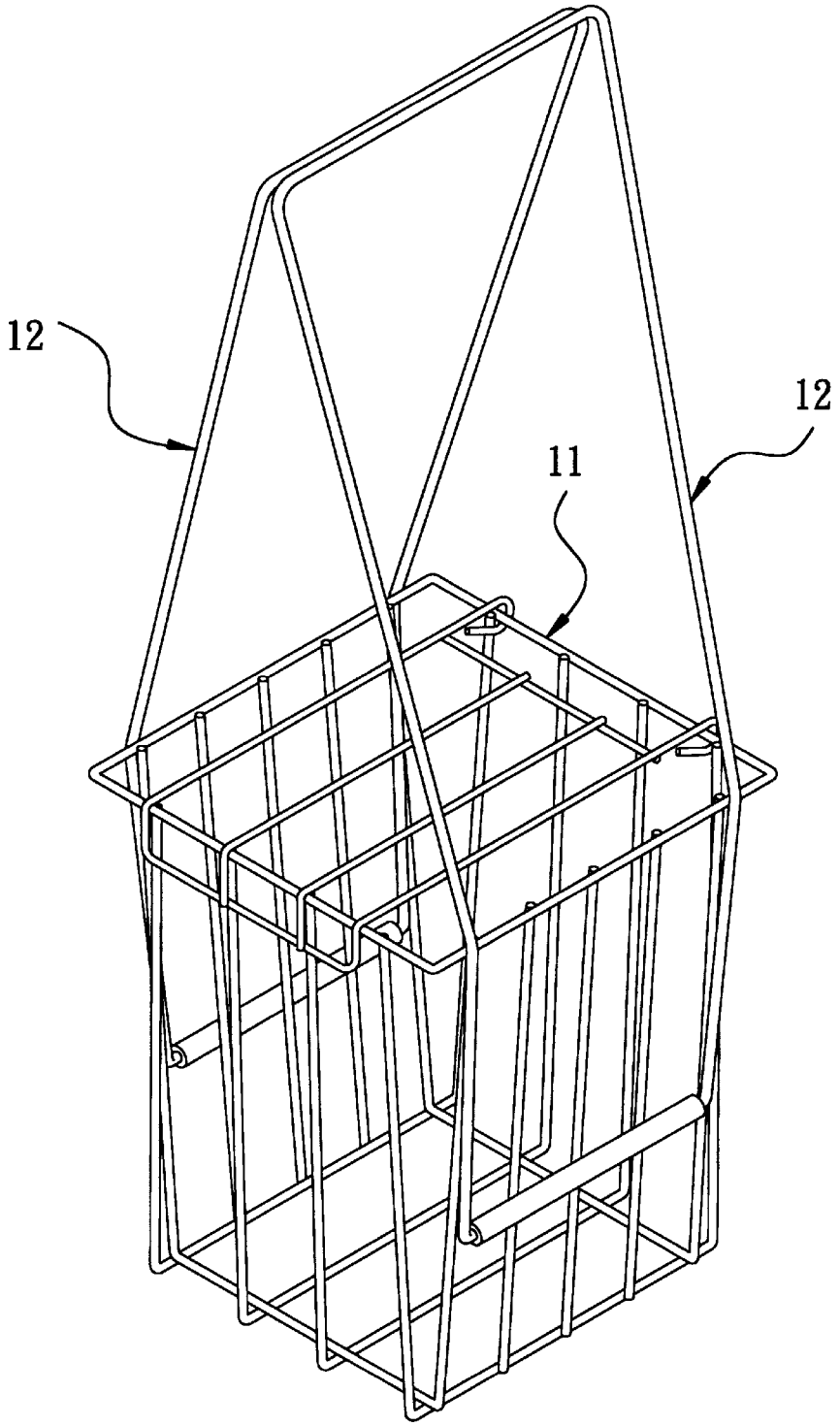
FIG. 2 PRIOR ART
FIG. 2 is a perspective view of the conventional basket assembly of FIG. 1 in a second operative position.
Figure 3:
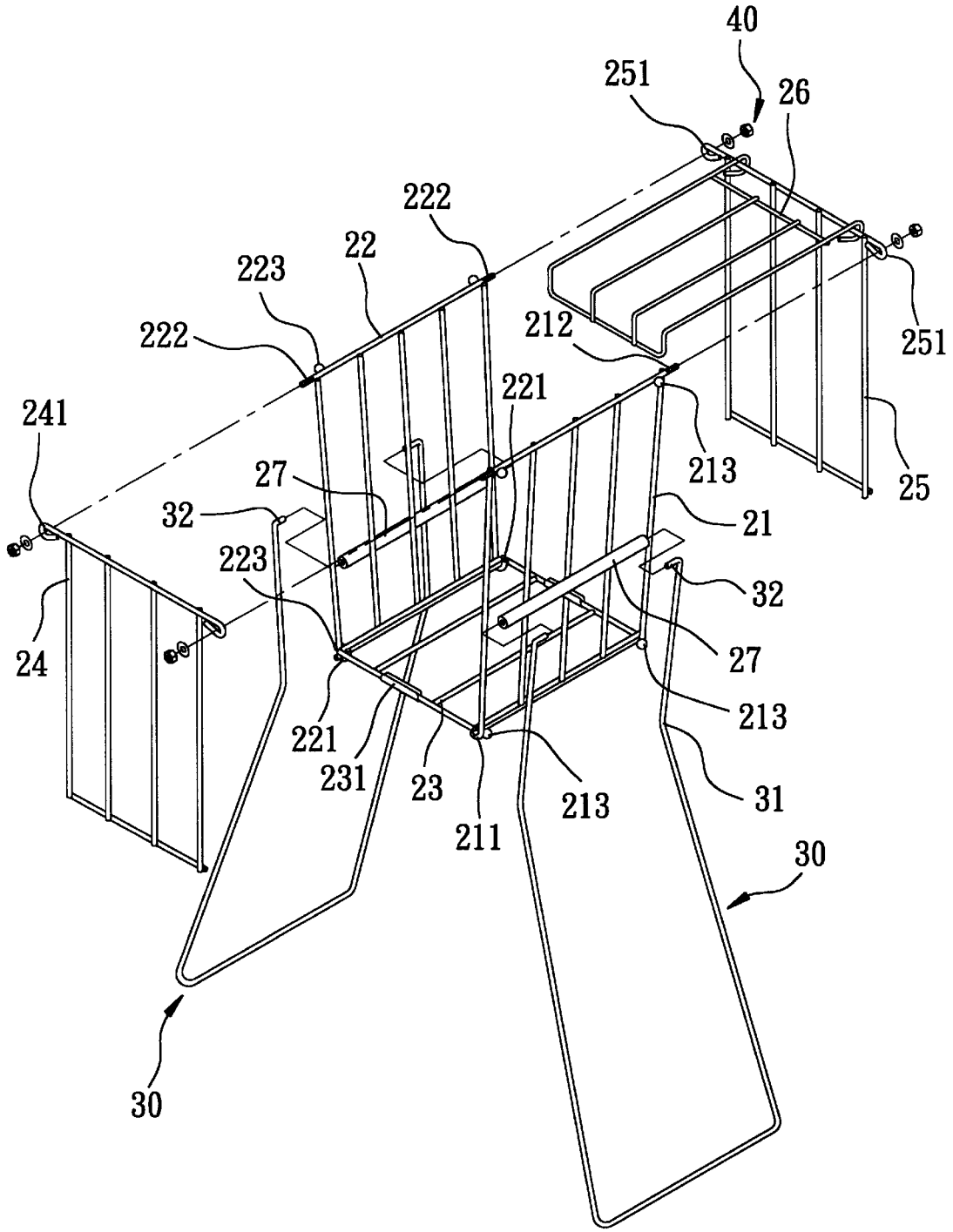
FIG. 3 is an exploded view of a first preferred embodiment of a collapsible basket assembly according to the present invention.
Figure 4:
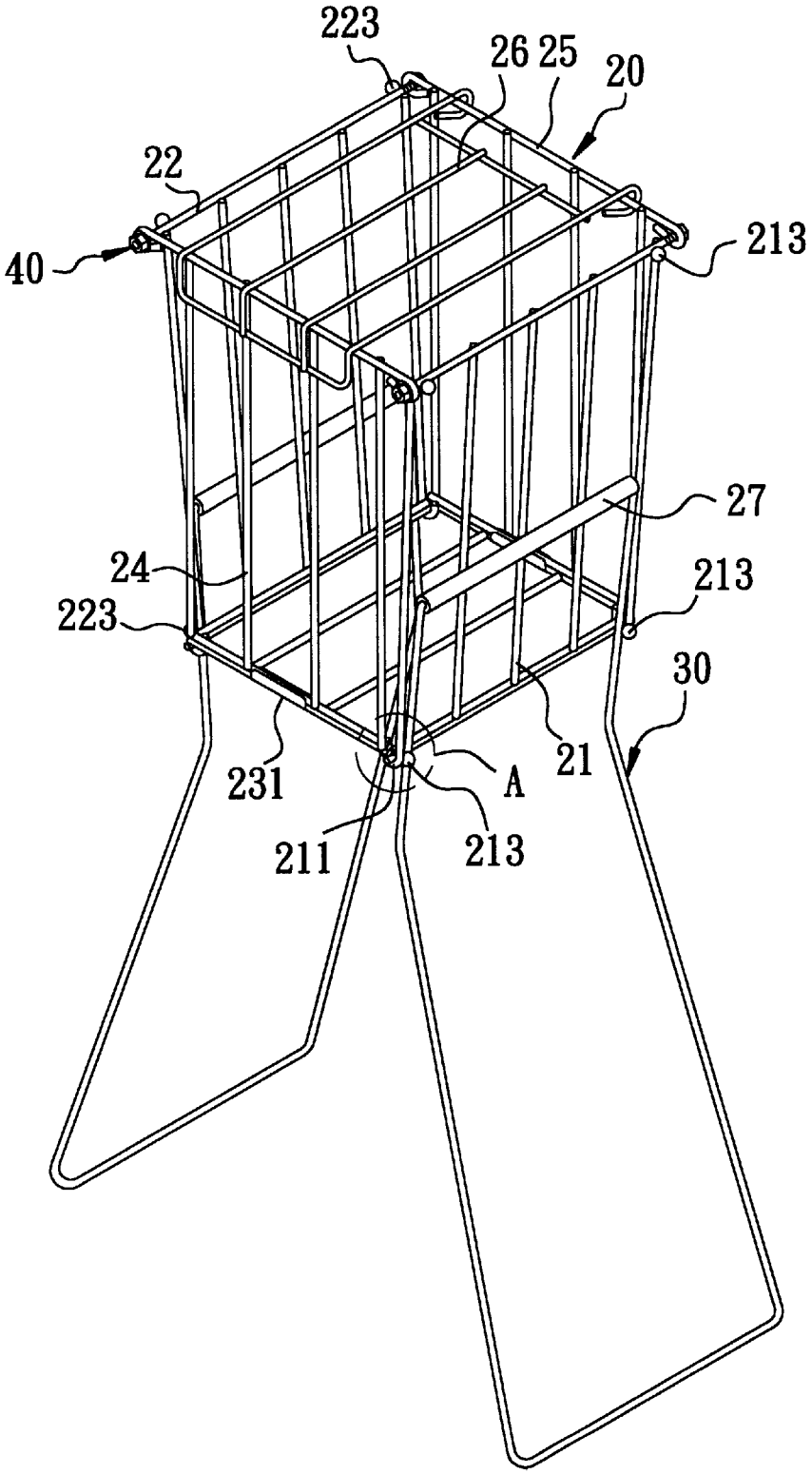
FIG. 4 is a perspective view of the first preferred embodiment of the collapsible basket assembly according to the present invention.
Figure 5:
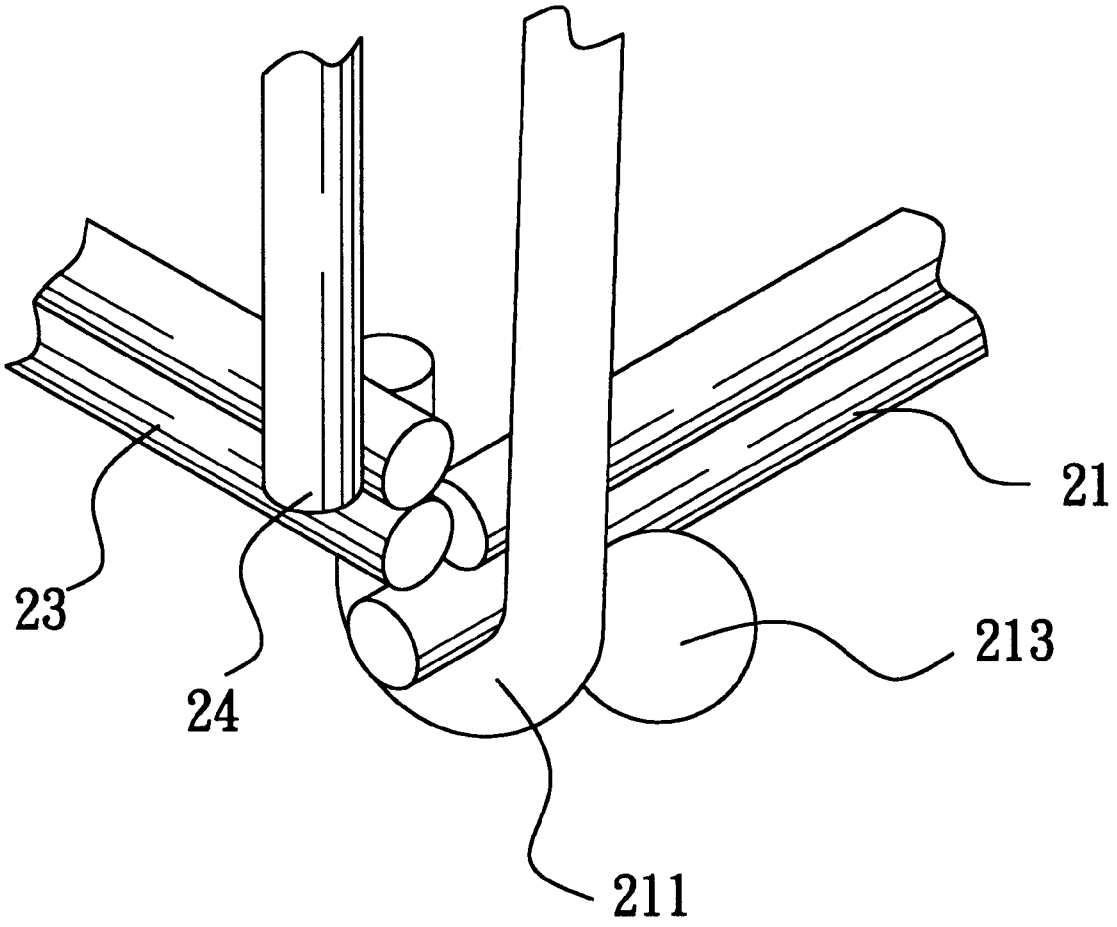
FIG. 5 is an enlarged view of an encircled portion (A) shown in FIG. 4.

Referring to FIGS. 3, 4 and 5, a first preferred embodiment of a collapsible basket assembly according to the present invention is shown to comprise a basket 20 and a pair of U-shaped members 30.

The basket 20 is formed of a front wall 21, a rear wall 22, a bottom wall 23, two opposite side walls 24, 25 interconnecting the front and rear walls 21, 22, and a top wall 26. Each of walls 21, 22, 23, 24, 25 is in the form of a grating have a plurality of metal rods welded to one another. The front and rear walls 21, 22 are connected pivotally to the bottom wall 25. More specifically, the bottom edges of the front and rear walls 21, 22 are formed with hook portions 211 that engage the metal rods of the bottom wall 23 so that the front and rear walls 21, 22 can turn toward and away from the bottomwall 23. Each of the top edges of the side walls 24, 25 has two loops 241, 251 formed on opposite ends thereof. The bottom wall 23 has two U-shaped clamps 231 provided on two opposite side edges thereof and engaging rotatably and detachably bottom edges of the side walls 24, 25. Two horizontal pivot tubes 27 are connected respectively to the front and rear walls 21, 22 between the top and bottom edges of the same. The opposite ends of the top and bottom edges of each of the front and rear walls 21, 22 have bead members 213, 223 formed thereon.

In addition, the front and rear walls 21, 22 have two pairs of protrusions 212, 222 extending in opposite directions from opposite ends thereof at top edges of the front and rear walls 21, 22. Each of the protrusions 212, 222 extends through one of the loops 241, 251 on a respective one of the top edges of the side walls 24, 25. The protrusions 212, 222 have threads formed outwardly of the loops 241, 251. Nuts 40 engage respectively the threads on the projections 212, 222 in order to prevent disengagement between the protrusions 212, 222 and the loops 241, 251. As such, the side walls 24, 25 of the basket 20 can be separated from the front and rear walls 21, 22 by disengaging the nuts 40 from the protrusions 212, 22. The front and rear walls 21, 22 are then collapsible to the bottom wall 23. Therefore, the volume of the basket 20 can be reduced dramatically as compared to the aforementioned conventional basket assembly, thus resulting in ease of storage and transport of the basket assembly 10.

Figure 6:
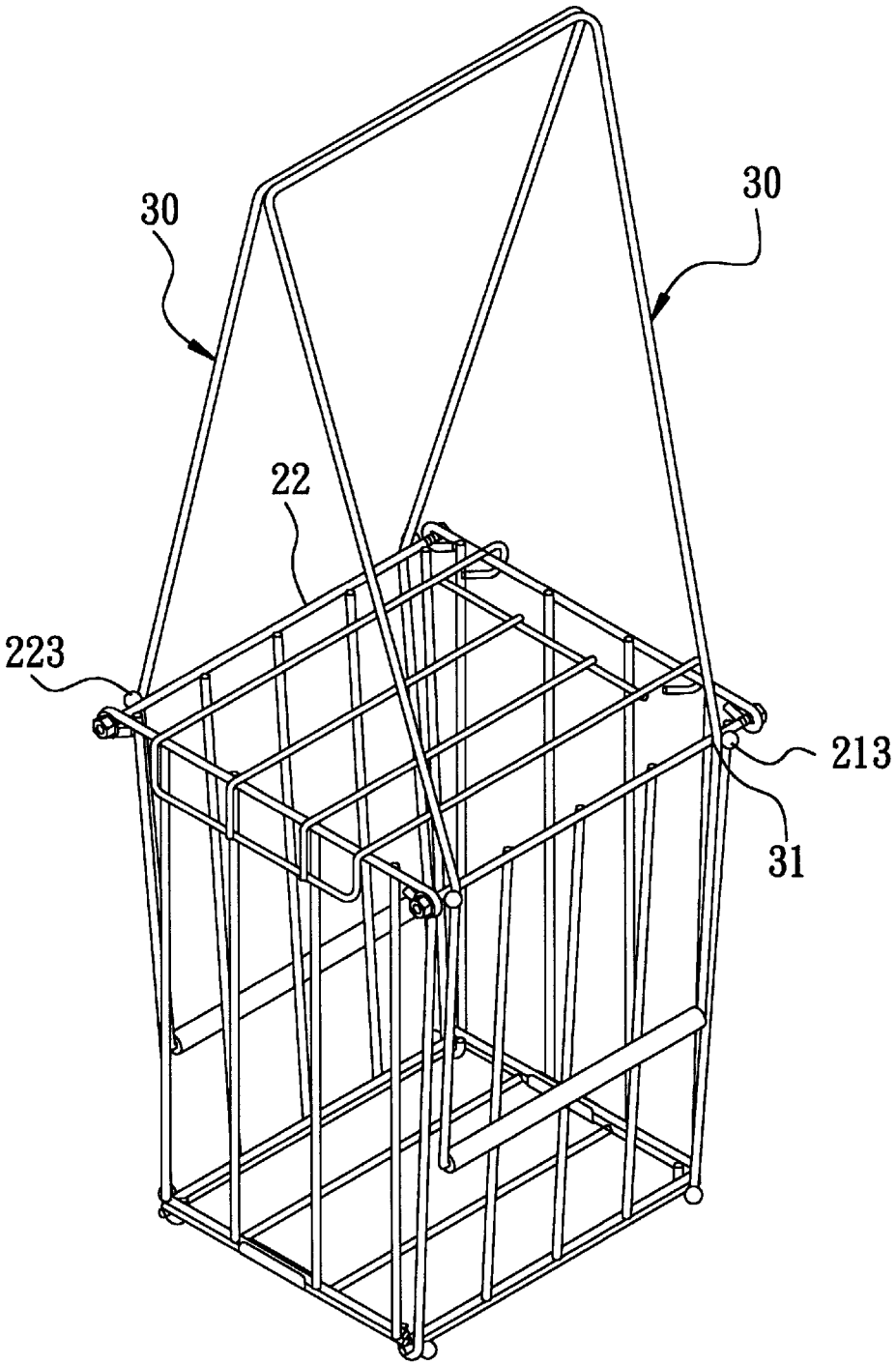
FIG. 6 is a perspective view of the first preferred embodiment of the collapsible basket assembly in a second operative position.

Each of the U-shaped members 30 has two arm portions 31 with bent distal ends 32 connected pivotally to opposed ends of a respective one of the pivot tubes 27. The arm portions 31 of the U-shaped members 30 are kept between and abut against two adjacent ones of the bead members 231, 223 to prevent the arm portions 31 from moving away from the front and rear walls 21, 22 when the U-shaped members 30 are rotated downwardly to support the basket 20, as best illustrated in FIG. 4, or upwardly to serve as a handle, as best illustrated in FIG. 6. Therefore, the arm portions 31 of the U-shaped members 30 can be connected positively to the basket when in use.

Figure 7:
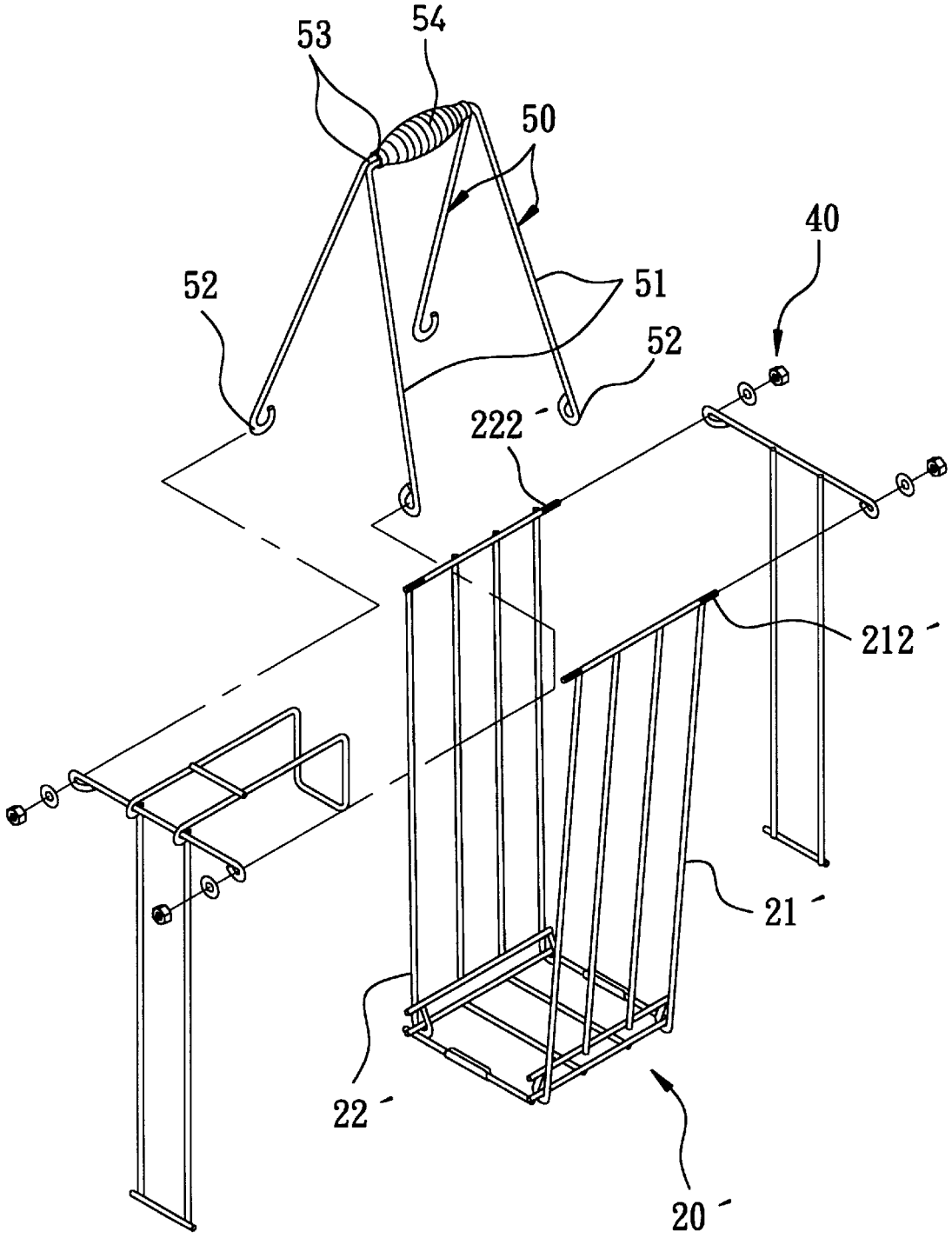
FIG. 7 is an exploded view of a second preferred embodiment of a collapsible basket assembly according to the present invention.

Referring to FIG. 7, a second preferred embodiment of a collapsible basket assembly according to the present invention is shown to include a basket 20' and a pair of U-shaped handles 50. In this embodiment, the horizontal pivot tubes 27 and the bead members 213, 223 of the basket 20 in the first preferred embodiment shown in FIG. 4 are eliminated. The U-shaped handles 50 have arm portions 51 and bridge portions 52 interconnecting the arm portions 51. The bridge portions 52 are bonded by a spring sleeve 54. The distal ends of the arm portions 51 are formed with loops 52. The protrusions 212', 222' of the front and rear walls of the basket 20' extend through the loops 52 and engage the nuts 40 to connect the U-shaped handles 50 and the basket 20'.

Figure 8:
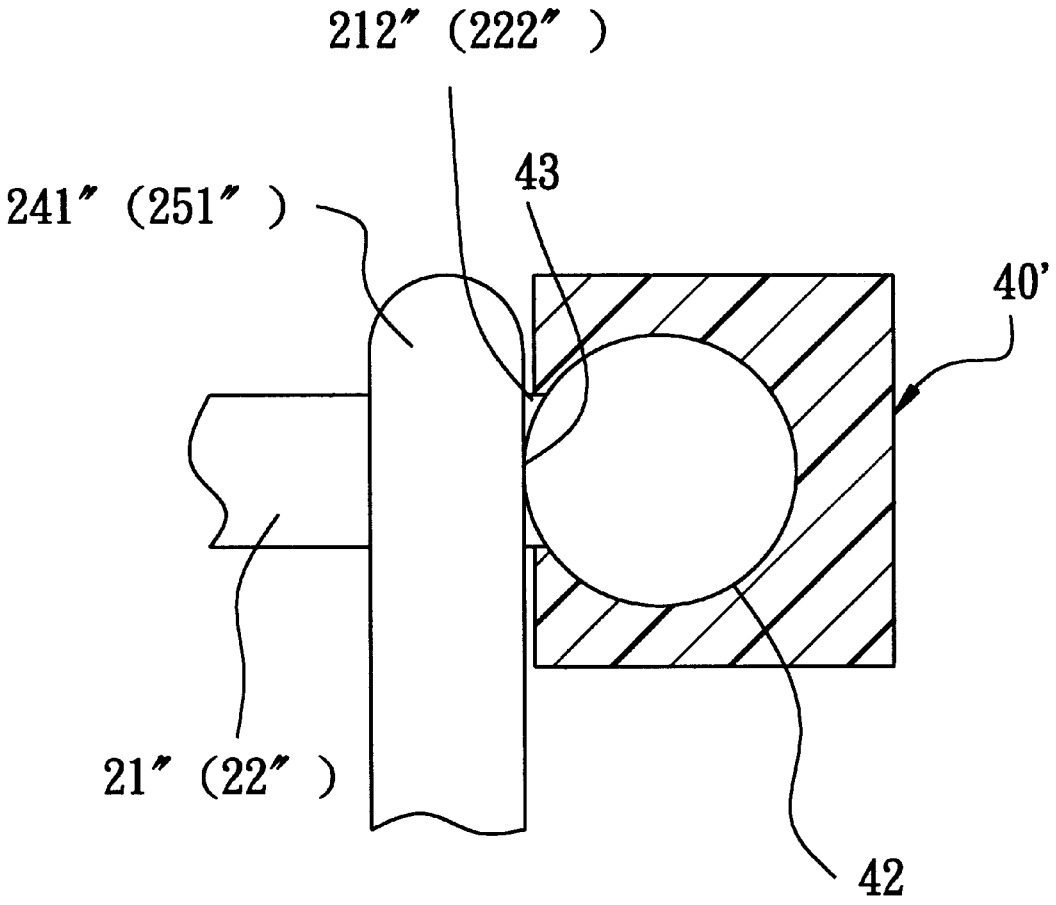
FIG. 8 is an enlarged fragmentary view of a third preferred embodiment of a collapsible basket assembly according to the present invention.

FIG. 8 shows a third preferred embodiment of a collapsible basket assembly according to the present invention. In this embodiment, enlarged circular ends are formed on the protrusions 212", 222" on the front and rear walls 21", 22" instead of the threads in the first preferred embodiment. Nuts 40 in the first preferred embodiment are replaced by rubbery locking blocks 40' that are made of, for example, polyurethane. Each of the locking blocks 40' has a socket 42 with a restricted mouth 43. The enlarged circular ends on the protrusions 212", 222" are forced through the mouths 43 and are received and retained in the sockets 42. As such, the disengagement between the protrusions 212", 222" and the loops 241", 251" can be prevented.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A collapsible basket assembly, comprising:

a basket having a front wall, a rear wall, two opposite side walls interconnecting said front and rear walls, and a bottom wall, said side walls having top edges, and bottom edges connected releaseably and pivotally to said bottom wall, each of said top edges of said side walls having two loops formed on opposite ends thereof;

said front and rear walls having top edges, and bottom edges connected pivotally to said bottom wall, each of said top edges of said front and rear walls having two protrusions extending in opposite directions from opposite ends thereof, each of said protrusions extending through one of said loops on a respective one of said top edges of said side walls;

two locking members connected removably to said protrusions to prevent disengagement between said protrusions and said loops;

a pair of U-shaped members, each having two arm portions with distal ends connected pivotally to said front and rear walls of said basket;

wherein said opposite ends of said top and bottom edges of each of said front and rear walls have bead members so that said arm portions of said U-shaped members are kept between and abut against two adjacent ones of said bead members to prevent said arm portions from moving away from said front and rear walls then said U-shaped members are rotated downwardly to support said basket or upwardly to serve as a handle.

* * * * *